US005212004A

United States Patent [19]

Böttcher et al.

[11] Patent Number: 5,212,004

[45] Date of Patent: May 18, 1993

[54] CERAMIC BOARD UTILIZED FOR THE CONSTRUCTION OF HEAT EXCHANGER PLATES

[75] Inventors: Jürgen Böttcher; Rudolf Ganz, both of Lauf; Otto Heinz, Neu Isenburg; Jörg Hönerlage, Kieselbronn, all of Fed. Rep. of Germany

[73] Assignee: Hoechst Aktiengesellschaft, Frankfurt am Main, Fed. Rep. of Germany

[21] Appl. No.: 730,692

[22] Filed: Jul. 16, 1991

[30] Foreign Application Priority Data

Jul. 17, 1990 [DE] Fed. Rep. of Germany ..... 4022654

[51] Int. Cl.[5] ..... F28F 3/08; F28F 21/04; B32B 3/10

[52] U.S. Cl. ..... 428/131; 428/137; 428/134; 428/136; 428/220; 428/338; 428/688; 165/166; 165/167

[58] Field of Search ..... 428/131, 137, 134, 136, 428/220, 338, 688; 165/166, 167

[56] References Cited

U.S. PATENT DOCUMENTS

| | | | |
|---|---|---|---|
| 2,610,835 | 9/1952 | Hytte | 165/167 |
| 2,656,159 | 10/1953 | Holm et al. | 165/166 |
| 4,526,635 | 7/1985 | Heinrich et al. | 165/166 |
| 4,880,055 | 11/1989 | Niggemann et al. | 165/167 |
| 4,934,453 | 6/1990 | Ganz et al. | 165/166 |
| 4,936,380 | 6/1990 | Niggemann | 165/167 |
| 5,016,707 | 5/1991 | Nguyen | 165/166 |
| 5,099,915 | 3/1992 | Van Dyke | 165/166 |

FOREIGN PATENT DOCUMENTS 0274695 7/1988 European Pat. Off. .

*Primary Examiner*—Ellis P. Robinson
*Assistant Examiner*—William P. Watkins, III
*Attorney, Agent, or Firm*—Curtis, Morris & Safford

[57] ABSTRACT

In the board of ceramic material for the construction of permeable structures, the board has three rows of holes which extend parallel to one another and are arranged symmetrically to the axis of symmetry. Three recesses of differing length are arranged between the rows of holes. The recesses intersect the board edge, the longest and one of the two shorter ones opening out at the same board edge and the shortest being opposite the second longest. The webs remaining between the recesses or the recess and the board edge have a length of 25%±0 to 6% in relation to the length of the board determined by the direction of the rows of holes. The boards are stacked in succession to form various layers of the plate heat exchanger as the holes of the stacked boards form continuous channels and the recesses form shallow channels which extend substantially transversely to the continuous channels.

3 Claims, 4 Drawing Sheets

1
2
3
4
5
6
6a
7
8
9
10
11
12

CERAMIC BOARD UTILIZED FOR THE CONSTRUCTION OF HEAT EXCHANGER PLATES

DESCRIPTION

The invention relates to a board of ceramic material for the construction of permeable structures, especially for the construction of crossflow heat exchangers.

Boards of the type mentioned and permeable structures produced from these are known from DE-A-3,643,750. The known boards have first recesses which, when the boards are stacked, form continuous channels. Second recesses are so arranged round the first recesses that the second recesses of adjacent boards partially overlap, thereby forming channels which extend perpendicularly to the continuous channels and which surround these. A disadvantage is the high flow resistance in the channels which are formed by the second recesses. The invention is intended to remedy this.

The object is achieved by means of a board of ceramic material which is defined in that the board has three rows of holes which extend parallel to one another and are arranged symmetrically to the axis of symmetry and between which are arranged three recesses of differing length which intersect the board edge, the longest and one of the two shorter ones opening out at the same board edge and the shortest being opposite the second longest, and the webs remaining between the recesses or recess and the board edge having a length of 25%±0 to 6% in relation to the length of the board determined by the direction of the rows of holes.

The webs remaining between the holes of a row of holes and a row of holes and the recesses can be 1 to 10 mm wide and the recesses 1 to 50 mm.

With regard to permeable structures consisting of fired ceramic material and produced from punched and laminated green ceramic boards as claimed in claim 1, the boards are stacked alternately one above the other by rotation about the axis of symmetry defined by the middle row of holes and about the perpendicular to this, with the boards stacked the holes forming continuous channels and the recesses forming shallow channels which extend essentially transversely to the continuous channels. The holes can be of any geometrical form, for example circular, oval, triangular to polygonal.

The advantages of the invention are to be seen essentially in that the exchange of media between adjacent shallow channels can be made variable or prevented by a variation of the web length between the board edge and the longest recess or the second longest and shortest recess by up to ±6%. Furthermore, the flow resistance decreases because the shallow channels form continuous slits. The permeable structure can be constructed from a board pattern.

Moreover, structures for a plurality of parallel-flow media can be constructed by an appropriate design of the closing foils. By a deviation of the hole centers from the common axis of the row of holes, it is possible to construct structures in which the channels formed by the holes acquire a stepped to helical surface.

The invention is explained in more detail below with reference to drawings illustrating only one possible embodiment. In these:

Figure 1:
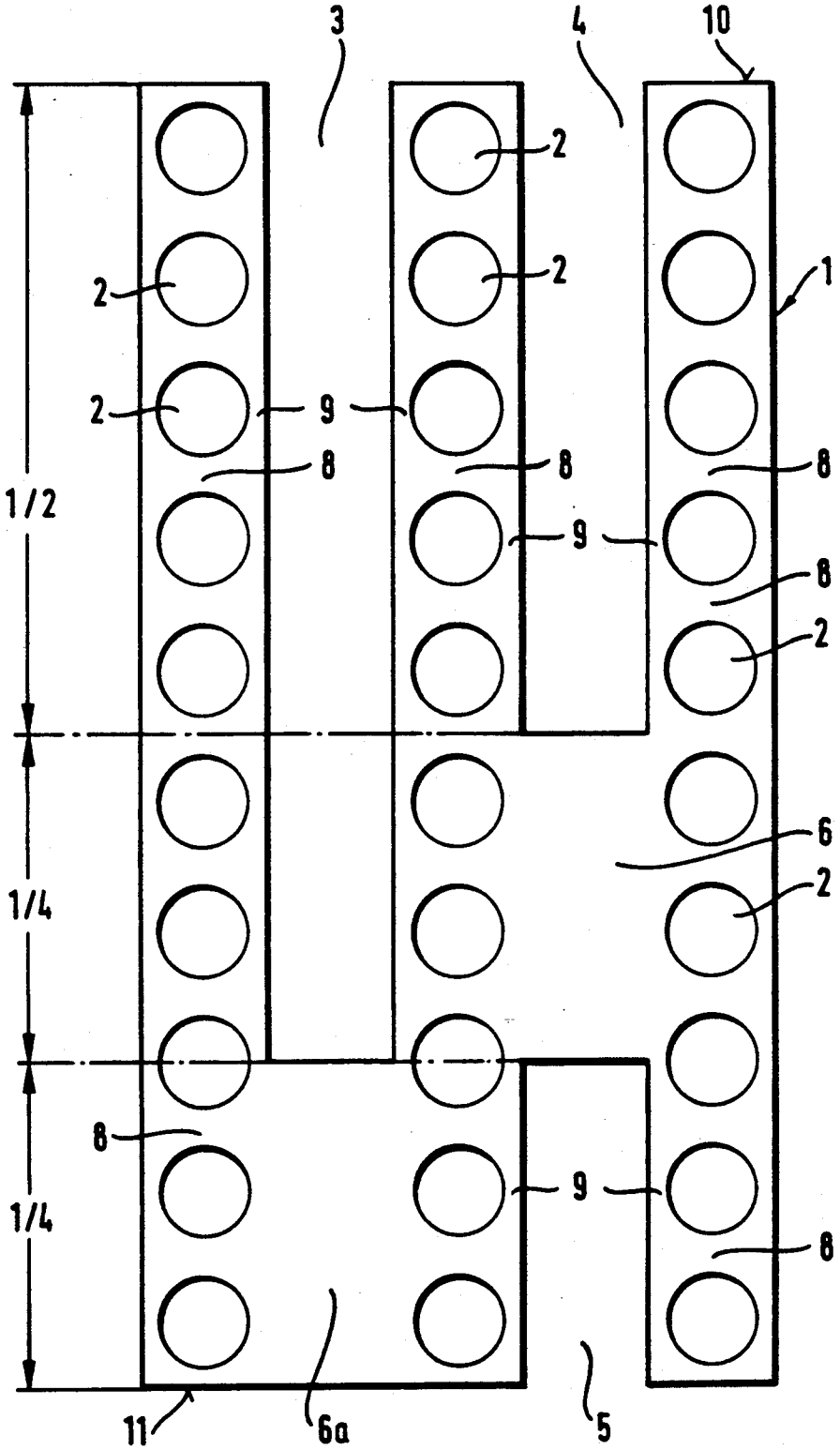
FIG. 1 shows a top view of the board according to the invention.

The board 1 consisting of green ceramic material has either 3, 5, 7 or 9 rows of holes extending parallel to one another and arranged symmetrically to the axis of symmetry. In FIG. 1, three rows of holes are illustrated. The holes 2 of a row of holes have a mutual spacing of 1 to 10 mm, that is to say the webs 8 remaining between them are 1 to 10 mm wide. Between the rows of holes are arranged recesses 3, 4, 5 of differing length.

Figure 2:
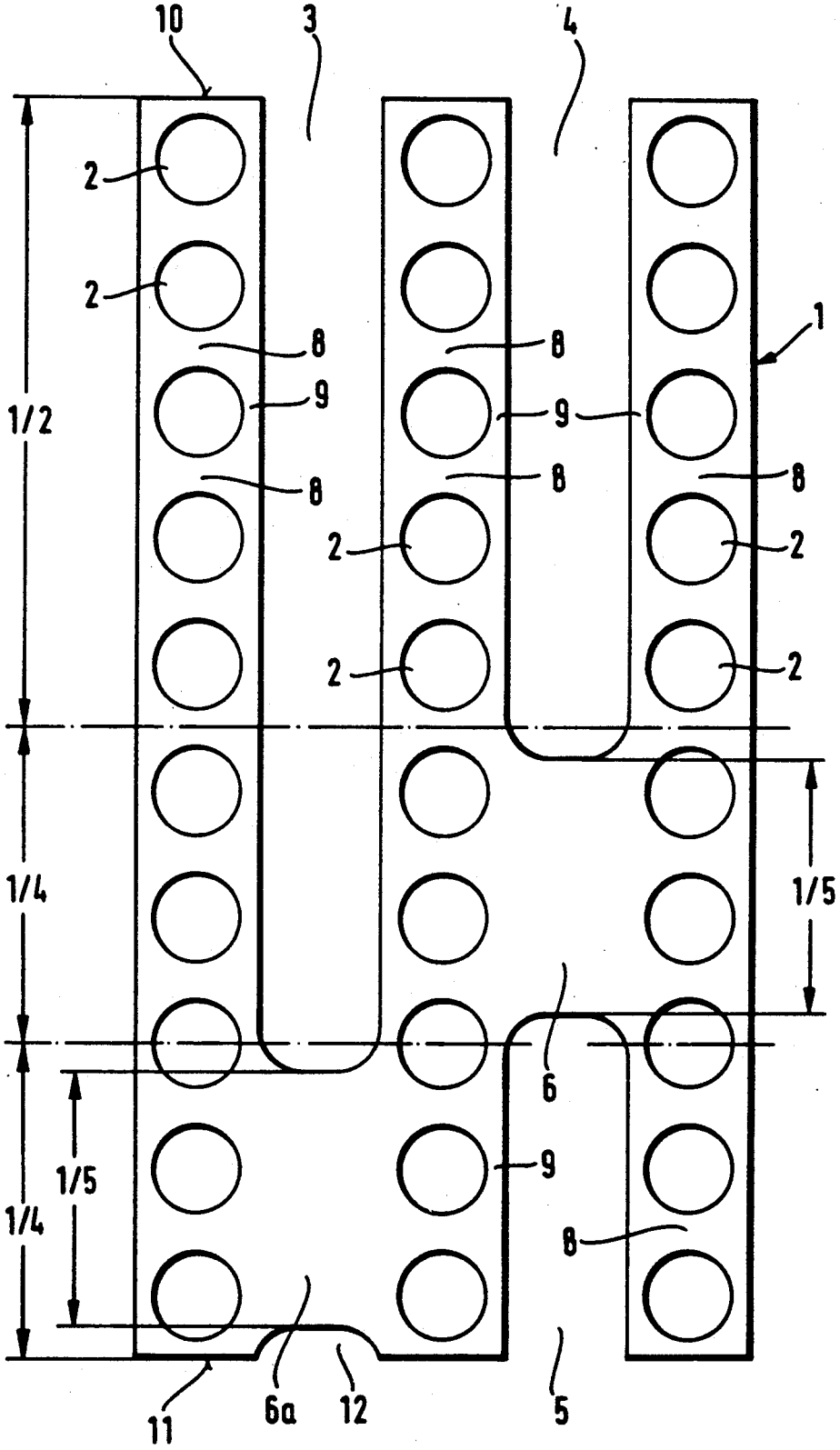
FIG. 2 shows a top view of an alternative to FIG. 1.

The recesses are 1 to 50 mm wide and have a spacing (web 9) of 1 to 10 mm from the rows of holes. All the recesses start at the edge of the board, that is to say they intersect it. The longest recess 3 and the second longest recess 4 intersect the same board edge 10. The shortest recess 5 is located opposite the second longest and intersects the board edge 11. The length of the webs 6, **6*a* remaining between the recesses 4 and 5 and between the recess 3 and the board edge amounts to 25%±0 to ±6% of the board length in the direction of the rows of holes. The length of the webs 6, 6*a* amounts according to FIG. 1 to 25% and according to FIG. 2 to approximately 20% of the board length. With shortened webs 6, 6*a*, the recesses of adjacent boards overlap, thereby forming channels which are continuous perpendicularly to the shallow channels and via which the individual shallow channels are connected to one another. This ensures a better swirling and mixing of the particular substance flow. If larger units are to be assembled from the structures, it can be advantageous to provide the board edge in the region of the web 6*a* with a recess 12, the length of which can amount to 3% of the board length. If the webs 6, 6*a*** are longer than 25% of the board length, they acquire the function of guide surfaces or cooling ribs.

Green boards of ceramic material cannot be produced in every thickness. By laminating individual boards on one another, it is possible to make plates and blocks which are then each a multiple of the board thickness. By subsequent firing, the laminated block becomes a homogeneous ceramic component. In addition to ceramic material, metal sheets or plastic foils can also be considered for the punched boards.

Figure 3:
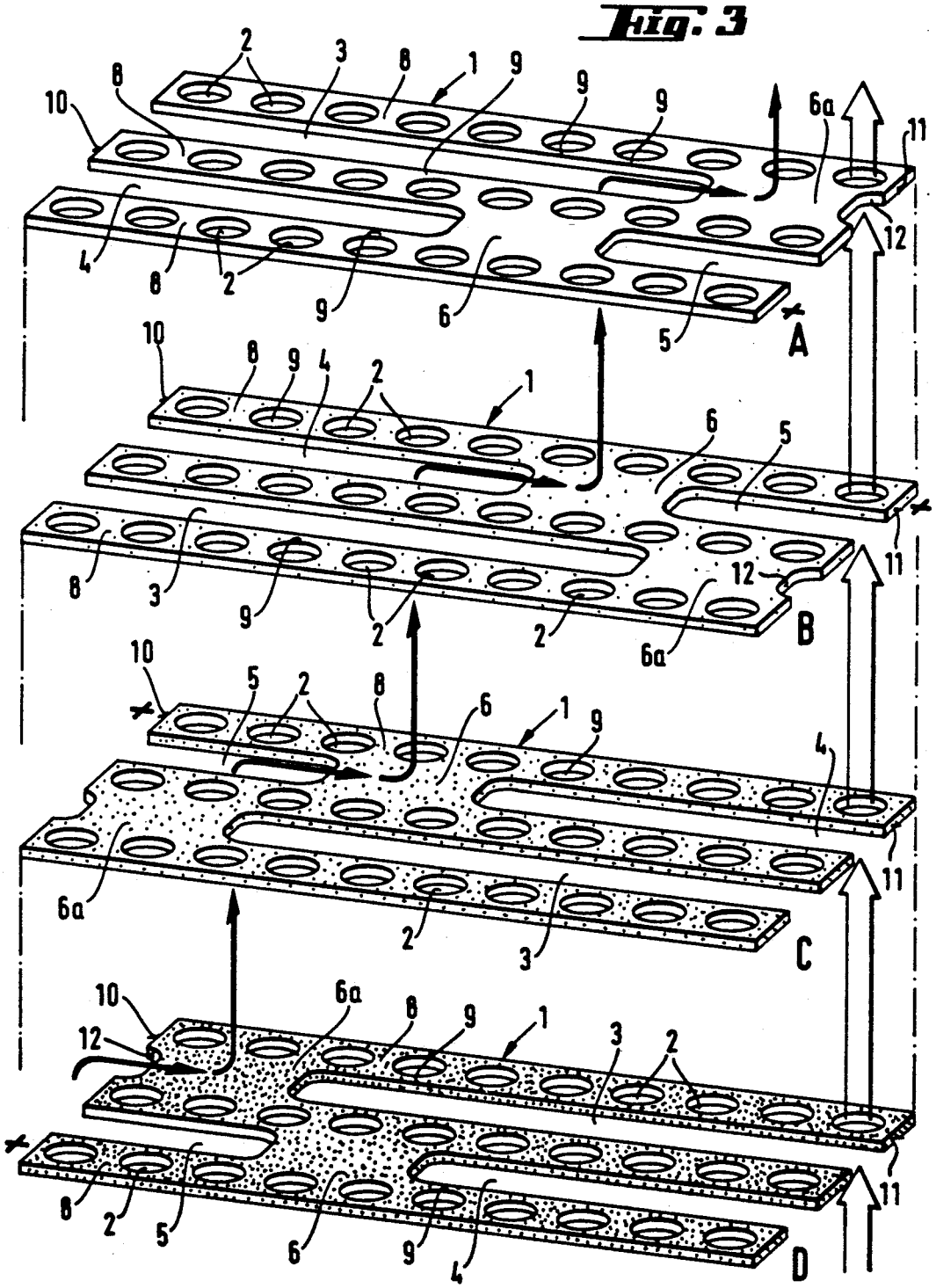
FIG. 3 shows an axonometric representation of the stacking sequence of the board according to FIG. 2.
Figure 4:
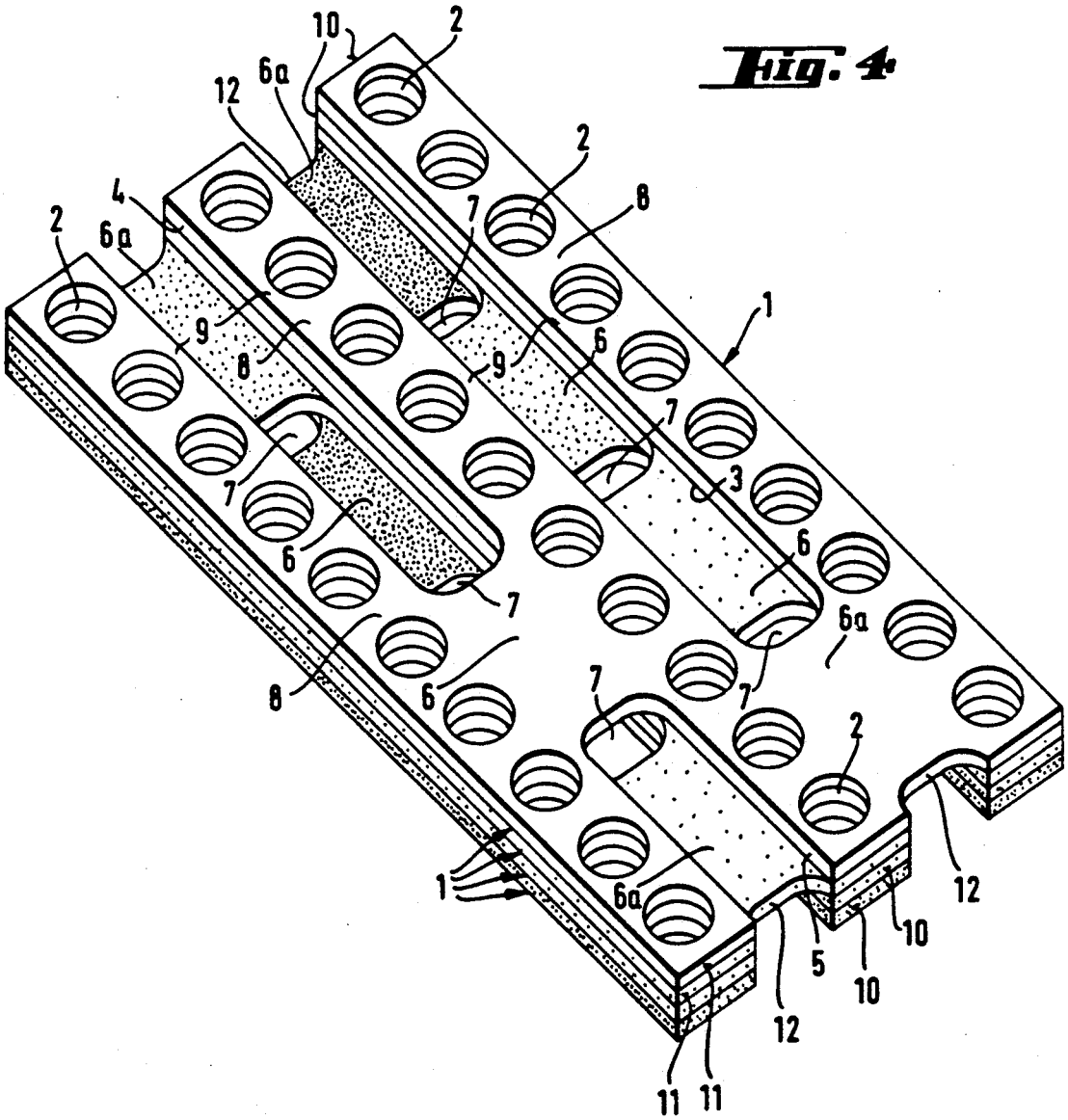
FIG. 4 shows an isometric representation of four stacked boards.

The surface ratio of hole channels to shallow channels can be influenced by these alternative constructions. The surface and channel cross-section of the holes always remain constant. But the surface and channel cross-section of the shallow channels can be varied by arranging a plurality of boards in the same position. The total throughflow cross-section also always remains the same in the shallow channels. The stacking of individual boards provides the highest surface ratio. A stacking of, for example, five boards 1 in the same position reduces the surface of the connecting webs 6, **6*a* to 1/5 and increases the individual channel cross-sections to five times for a constant total throughflow cross-section and for constant ratios of the holes. That is to say, in heat exchangers of the same external dimensions, the surface ratio can be varied in a simple way and thus adapted to meet particular requirements. The holes 2 in any form and number are so arranged on the board that, with the board 1 rotated, they always coincide perfectly with the holes 2 of the boards located above and below (FIG. 4). The stacking sequence (FIG. 3) which ensures a permeability of the structure for the second medium is in a series of four. One or more boards 1 arranged identically are brought into the positions A, B, C and D by rotation and are laminated onto one another in this position and sequence. That is to say, a particular board corner, represented by a plus sign, comes to rest successively at all four stack corners. Thus, board B is obtained by rotating board A about the axis of symmetry, board C by rotating board B about the perpendicular to the axis of symmetry and board D by rotating board C about the axis of symmetry (FIG. 3**). The stacks of four cards are repeated until the desired block height is reached. The block can be closed off by a respective covering board which contains only the rows of holes.

The board 1 described can be assembled to form larger units both in the longitudinal and in the transverse direction. In the longitudinal direction this is obtained simply by placing them next to one another in a row, and in the transverse direction one row of holes is always omitted because the number of rows of holes must always be an odd number.

What is claimed is:

1. A board of ceramic material for the construction of heat exchangers and heat exchanger plates, which board has three spaced-apart rows of holes which extend parallel to one another and are arranged symmetrically to the axis of the middle row of holes and between the rows of holes are arranged three recesses of differing length which intersect the board edge, the longest recess and one of the two shorter recesses opening out at the same board edge and the shortest recess being opposite to the second longest recess, and the webs remaining between the recesses or the recess and the board edge provide for heat exchange through the board and have a length of 25%±0 to 6% in relation to the length of the board determined by the direction of the rows of holes.

2. The board as claimed in claim 1, wherein the webs remaining between the holes of a row of holes and the rows of holes and the recesses are 1 to 10 mm wide and the width of the recesses is 1 to 50 mm.

3. A heat exchanger formed by the ceramic board as claimed in claim 1, wherein a plurality of boards are stacked alternately one above the other wherein a second board is rotated about the axis of the middle row of holes of a first board, a third board formed by rotating said second board about an axis of rotation perpendicular to the axis of symmetry of the middle row of holes of said second board, and a fourth board formed by rotating said third board about the axis of symmetry of said middle row of holes thereof such that the holes of the stacked boards form continuous channels and the recesses form shallow channels which extend essentially transversely to the continuous channels.

* * * * *